US006422548B1

(12) United States Patent
Baber et al.

(10) Patent No.: US 6,422,548 B1
(45) Date of Patent: Jul. 23, 2002

(54) ADJUSTABLE ZONED VACUUM BED

(75) Inventors: Zbigniew Baber, Glendale Heights; Thomas M. Dewbray, Darien; Jan Dolega, Harwood Heights; Zbigniew Kubas, Schiller Park; Remigiusz Kryszczuk, Niles; Marek Kwjecien, Harwood Heights; Boguslaw Magda, Wheaton; Dariusz Tkacz, Naperville, all of IL (US)

(73) Assignee: M&R Printing Equipment, Inc., Glen Ellyn, IL (US)

( * ) Notice: Subject to any disclaimer, the term of this patent is extended or adjusted under 35 U.S.C. 154(b) by 0 days.

(21) Appl. No.: 09/638,824

(22) Filed: Aug. 14, 2000

(51) Int. Cl.[7] ..... E25B 11/00
(52) U.S. Cl. ..... 269/21
(58) Field of Search ..... 269/21, 20; 279/3 R; 294/64.1; 451/388; 248/362, 363

(56) References Cited

U.S. PATENT DOCUMENTS

| | | | | | |
|---|---|---|---|---|---|
| 2,317,348 | A | * | 4/1943 | Wekeman | 269/21 |
| 3,328,022 | A | * | 6/1967 | Miller | 269/21 |
| 3,406,938 | A | * | 10/1968 | Muir | |
| 3,652,075 | A | * | 3/1972 | Thompson | 269/21 |
| 3,729,206 | A | * | 4/1973 | Cachon et al. | 269/21 |
| 3,741,116 | A | | 6/1973 | Green et al. | |
| 3,910,621 | A | * | 10/1975 | Hillier | 269/21 |
| 4,066,249 | A | * | 1/1978 | Huber et al. | 269/21 |
| 4,131,267 | A | * | 12/1978 | Ono et al. | 269/21 |
| 4,423,676 | A | | 1/1984 | Neel | |
| 4,643,093 | A | | 2/1987 | Goar et al. | |
| 4,766,811 | A | | 8/1988 | Linska | |
| 5,195,434 | A | | 3/1993 | Hoffman | |
| 5,394,796 | A | | 3/1995 | Jones et al. | |
| 5,857,667 | A | * | 1/1999 | Lee | 269/21 |
| 5,927,193 | A | | 7/1999 | Balz et al. | |

* cited by examiner

*Primary Examiner*—Robert C. Watson
(74) *Attorney, Agent, or Firm*—Wallenstein & Wagner, Ltd.

(57) ABSTRACT

A vacuum bed (110,210,310,410,510) for holding an article on and to the top sheet (25) of the bed is disclosed. The top sheet (25) includes a plurality of holes (34) therein. The bed further has a bottom sheet (21) spaced apart from and below the top sheet (25). A vacuum chamber (30) is formed between the bottom and top sheets (21,25). A vacuum source (8) in communications with the vacuum chamber (30) draws air through the holes (34) in the top sheet (25) forming a vacuum zone (120,220,320,420,520). Means are disclosed within the vacuum chamber (30) to control and adjust the size of the vacuum zone created on the top sheet (25) to hold articles of different widths and heights.

52 Claims, 8 Drawing Sheets

ADJUSTABLE ZONED VACUUM BED

TECHNICAL FIELD

The present invention relates to tables or beds for supporting substrates being printed upon, and more particularly, to stationary or movable beds or tables used in graphic printing machines incorporating a vacuum to hold an article being printed upon in place.

BACKGROUND

Assignee of the present invention, M&R Printing Equipment, Inc., Glen Ellyn, Ill., makes several successful printing presses, such as the PROCESSOR®, the RENEGADE™, the LONG STROKE™, the PATRIOT®, the ECLIPSE™, the SATURN™, and the CONQUEST™ screen printing systems. In such systems an article to be printed upon, usually paper or film, is placed upon a bed or table and the table is either stationary or moved through stations where colors are applied to the article. Each color is applied separately through screen printing. At times during the printing process the article is also cured or dried through conventional and well known means to set the ink and prevent smearing etc. It is critical to maintain the article to the bed or table in a set position to ensure consistent and accurate indexing or registration. In short, the article must not move while it is in the system and being worked upon. Any movement will cause misalignment of the images printed upon.

To accomplish this, the article is fixed to the bed by vacuum forces. The vacuum created holds the article/substrate to the table and in a fixed, set position. The substrate is first laid or placed on the table's top surface and next positioned and oriented on the table. The vacuum is turned on and the substrate is held in place. The table or bed then progresses through the printing machine and is printed upon. Thus, while the table is moved to printing or curing stations and/or acted upon by the printing or curing operation, the article/substrate does not move relative to the table/bed.

The vacuum is achieved by having the bed/table communicating with a vacuum blower and small vacuum holes in the upper surface of the table/bed, namely the surface contacting the article. The vacuum within the bed causes suction from the small openings, pulling the substrate to the table and holding the substrate in the fixed position.

The beds can be very large planar surfaces (e.g., 156" (vertical) by 72" (horizontal)). They can hold sheets of many different sizes. The zone of vacuum from the bed is generally the entire upper surface. As such, the entire bed is drawing a vacuum if the sheet is large or if the sheet is small. There is presently no way of controlling this vacuum zone, e.g., applying the vacuum only to the area of need or the size of the sheet. If a sheet is only an eighth of the size of the table, seven-eighths of the table will unnecessarily be drawing air with nothing to hold down. This diminishes the vacuum and reduces the hold-down abilities of the system. Indeed, to maintain a proper vacuum to hold a sheet on a table, the vacuum zone (the area on the table where a vacuum is present from the table acting upon the sheet resting upon the table) should correspond directly to the exact location, orientation, size and shape of the sheet.

Consequently, to optimize the vacuum created on the article, the portion of the bed not covered by the article is masked, meaning the small vacuum holes are covered with tape. In actuality, a worker or operator masks off the top surface with tape in those areas void of the substrate or sheet.

This is very time consuming and can take hours for each project. Thus, if the sheet being printed upon is only a third the size of the bed, two-thirds of the bed is masked by hand. This translates to lost production time, wasted materials [tape] and increased expenses.

As a result, there is a need to control the size and location of the zone of the vacuum on the surface of the bed/table so that articles and substrates of different sizes can be easily accommodated.

SUMMARY OF THE INVENTION

The present invention discloses techniques and systems for controlling the vacuum area on the bed. The vacuum zone can be adjusted and maintained within minutes as opposed to hours. It can easily be changed from print job to print job and can be replicated for similar jobs. An operator can adjust the location and size of the area on the bed to draw the vacuum. Five embodiments and techniques are disclosed herein.

According to an aspect of the present invention, a vacuum table or bed for holding an article or substrate, such as paper, on the top thereof is disclosed. The table includes a table body having a vacuum source connected to it. The table has a plurality of air holes in the top which define a vacuum zone. This vacuum zone is the zone of "suction" caused by drawing air through the holes in the table by the vacuum connected to the table. The size of this zone is adjustable to accommodate articles having different widths and heights. Specifically, the table has a top sheet having a plurality of holes spaced apart therein and a bottom sheet spaced apart from and below the top sheet. The vacuum chamber is formed between the bottom sheet and the top sheet. The vacuum source, commonly a vacuum blower, is in communications with this vacuum chamber such that surrounding air is drawn through the holes in the top sheet. This aggregate or collection of holes in the top sheet drawing air define the vacuum zone to hold the substrate on the top sheet and to the top sheet. The vacuum chamber acts as a large valve or control center for directing air and vacuum between the vacuum source and the top sheet. In its simplest form, this chamber turns off certain portions of the chamber and turns on other portions of the chamber. In those "on" areas in the chamber, a vacuum is formed in the top sheet generally directly above this portion of the chamber [the vacuum zone]. In the "off" portions of the chamber, air does not flow and no vacuum is formed in the top sheet.

A separation sheet with perforations therein is disposed between the top sheet and the bottom sheet and above the vacuum chamber. A honeycomb support structure with openings therein is disposed between the top sheet and the bottom sheet and above the separation sheet. Thus, air drawn through the holes in the top sheet pass through the openings in the honeycomb support structure and through the perforations in the separation sheet to the vacuum chamber.

Several techniques are shown to adjust both the width and the height of the vacuum zone. In some of the embodiments the position of this vacuum zone is also adjustable. This allows one to control and adjust the size of the vacuum zone created on the top sheet to hold substrates of different sizes. In a first embodiment the means within the vacuum chamber for controlling and adjusting both the height and the width of the vacuum zone includes a plurality of L-shaped channels in communications with a primary vacuum tube. Two pistons are moveable within this primary vacuum tube to block air from being drawn through select L-shaped channels. The pistons are interconnected to one another by a screw such that they simultaneously move towards one another or away from one another. By moving the pistons, air is blocked from selected channels. The blocked channels do not draw any air through the holes in the top sheet above the blocked channels. Thus, by increasing the number of channels blocked, the size of the vacuum zone is reduced. Because of the L-shape of the channels and their alternating configuration (right faced channel, left faced channel, right face channel) both the horizontal and vertical size of the vacuum zone are affected by moving the pistons.

In a second embodiment the means within the vacuum chamber to control and adjust the size of the vacuum zone includes a plurality of vertical gates or stip valves with apertures therein and horizontal gates or strip valves with apertures therein. Each gate is movable between an open position, wherein the air can flow between the vacuum chamber and the top sheet, and a closed position, wherein the air is prevented from flowing between the vacuum chamber and the top sheet. Each gate is a substantially flat stip with a plurality of collinear apertures therein. The vertical gates are parallel to one another and the horizontal gates are parallel to one another. The vertical gates are substantially perpendicular to the horizontal gates. In the open position the apertures in the gate are aligned with the perforations in the separation sheet adjacent the gate and the holes in the top sheet. Each gate can be independently set to open or closed; thus, both the location and the size of the vacuum zone can be set. When two gates are open, the air is free to flow between the top sheet and vacuum chamber. A vacuum is thus generated on the top sheet just above the open gates. By closing one gate, air is blocked between the vacuum chamber and the holes in the top sheet directly above the closed gate. In short, the blocked area does not draw any air through the holes in the top sheet directly above it. Thus, by increasing the number of closed gates, the vacuum zone is reduced. Because the gates are oriented along two axis, both the horizontal and vertical size of the vacuum zone can be affected by opening/closing gates.

In a third embodiment the means within the vacuum chamber to adjust the size of the vacuum zone includes a means for controlling and adjusting the width of the vacuum zone and a separate means for controlling and adjusting the height of the vacuum zone. The means for controlling and adjusting the height of the vacuum zone includes a plurality of horizontal channels in communications with a vertical primary vacuum tube. Like the first embodiment, two pistons are moveable within the primary vacuum tube to block air from being drawn through select channels. However, in this embodiment, the pistons are independent of one another. The means for controlling and adjusting the width of the vacuum zone includes a plurality of blocks, one block in each channel, that are movable within the channels. The blocks are interconnected to one another such that by moving one block, other blocks move with that one block. The blocks are connected to one another by cables entrained around pulleys.

Thus, four control handles adjacent the bed control the location and the size of the vacuum zone; two handles control the position of the pistons with each handle connected to a piston and two handles control the blocks with each handle connected to approximately half the blocks. Again, by moving the pistons, air is blocked from selected horizontal channels. The blocked channels do not draw any air through the holes in the top sheet above the blocked channels. By increasing the number of channels blocked, the vacuum zone is reduced. This blocking controls the size of the vacuum zone in one direction. The blocks within the channels control the size of the vacuum zone in the other direction. Specifically, the blocks within the channels can be moved towards the primary vacuum tube which will reduce the size of the vacuum zone by blocking air flow in part of the channels.

In the fourth embodiment, the means within the vacuum chamber to adjust the size of the vacuum zone includes both a means for controlling and adjusting the width of the vacuum zone and a separate means for controlling and adjusting the height of the vacuum zone. The means for controlling and adjusting the height of the vacuum zone includes a plurality of horizontal channels in communications with a vertical primary vacuum tube. At least two pistons moveable within the primary vacuum tube are provided to block air from being drawn through select channels. The means for controlling and adjusting the width of the vacuum zone includes a plurality of parallel gates transversing the parallel channels. Each gate is movable between an open position and a closed position. In the open position, air flowing in the channel can pass through the gate and eventually between the vacuum chamber and the top sheet in that portion of the unblocked channel. In the closed position, air is prevented from flowing through the gate, blocking off a portion of the channel and preventing air from flowing above that blocked portion of the channel to the top sheet.

Each gate is a hollow sleeve with opposed openings therein and a core slidably positioned within the sleeve having passageways therein. In the open position the passageways within the core are aligned with the openings in the sleeve. In the closed position the passageways within the core are not aligned with the openings in the sleeve. Each gate can be independently set to open or closed, thus controlling the size of the vacuum zone. As before, by moving the pistons, air is blocked from selected channels. The blocked channels do not draw any air through the holes in the top sheet above the blocked channels. Thus, by increasing the number of channels blocked, the vacuum zone is reduced. By moving the blocks, portions of the channels are blocked off and air is blocked from that portion of the channel. A vacuum is thus not created in the area on the top sheet where the channels below the top sheet are blocked.

In the fifth embodiment the means within the vacuum chamber to control and adjust the size of the vacuum zone includes a hose positioned within the vacuum chamber that can inflated and deflated. A plurality of handles adjacent the bed are provided for positioning the horizontal and vertical boundaries or borders of the hose. The handles are maneuvered to put the deflated hose in a desired location. The hose thus forms a "closed" boundary (e.g., a polygon, such as a square or rectangle, or a circle). The hose is inflated and seals the vacuum chamber by its expansion. The area within the boundaries of the hose are in communication with the vacuum source. Thus the vacuum zone is formed on the top sheet in the area above the inflated hose within the boundaries of the hose. Those areas outside the boundaries of the hose do not draw air through the top sheet and thus not under a vacuum.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
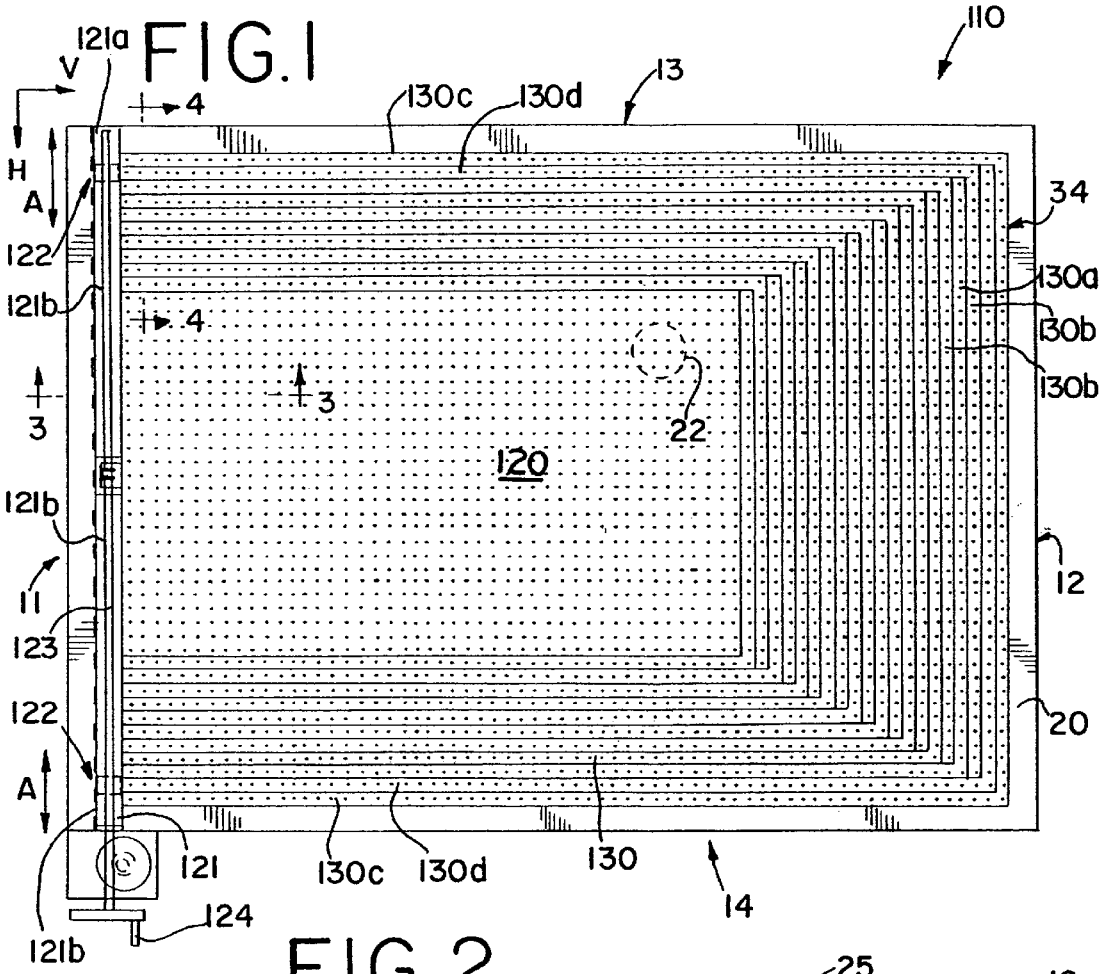
FIG. 1 is a top plan view of the table or bed made in accordance with the teachings of the first embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Basic Construction

Turning to the Figures, the reference number 110 designates the table of the first embodiment of the present invention. Throughout this disclosure, like numbers represent like or similar components or parts. Thus, the reference number 210 designates the table of the second embodiment. The reference numbers 310, 410 and 510 designate the tables of the second, third, fourth and fifth embodiments respectively. Those items which are virtually identical in all of the tables are identified with reference numbers under 100. For consistency and understanding, each bed has a horizontal axis (H) and a vertical axis (V).

Figure 2:
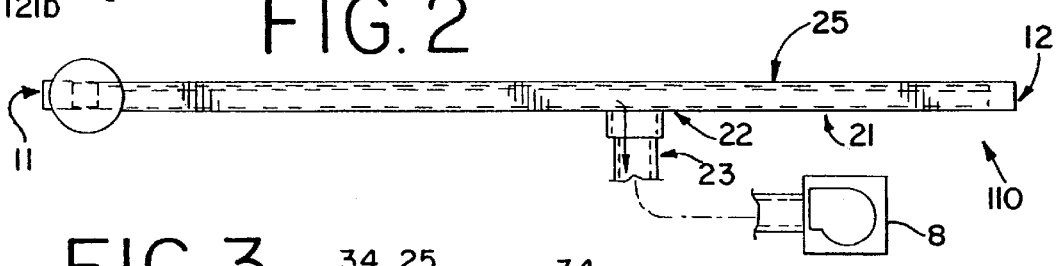
FIG. 2 is a side elevation view of the table of FIG. 1.

The bed has a front edge or surface 11, a parallel, opposed rear edge 12 and two opposed side edges 13,14. Each bed further has a bottom or lower surface 21 and a top or upper surface 25. The lower surface has an orifice 22 therein for a vacuum line 23 to be connected. The vacuum line 23 is in direct communications with the blower 8 (FIG. 2) for the vacuum.

Figure 3:
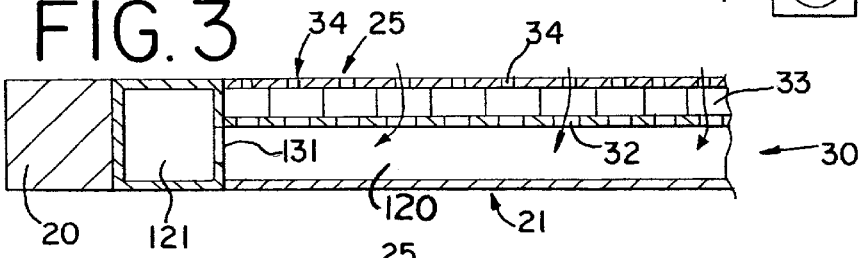
FIG. 3 is a sectional view along line 3—3 in FIG. 1.
Figure 4:
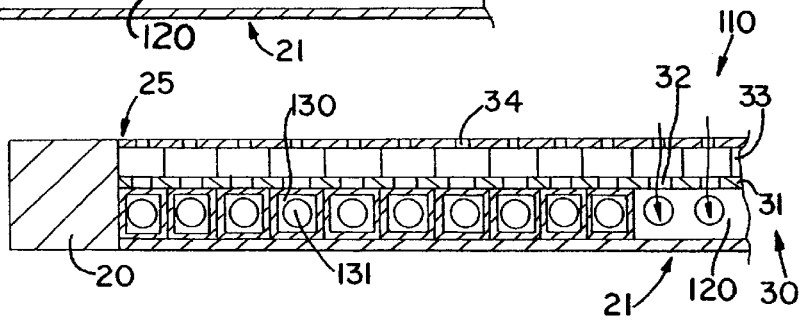
FIG. 4 is a sectional view along line 4—4 in FIG. 1.
Figure 5:
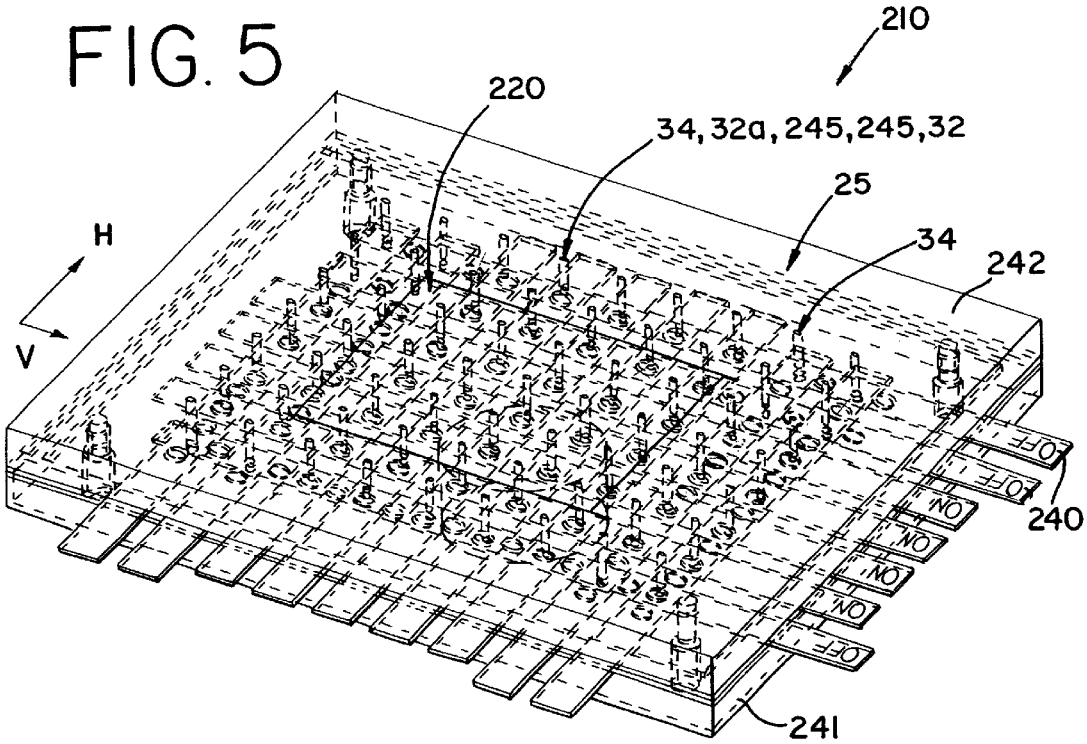
FIG. 5 is a schematic perspective view of the table with the upper surface in place and made in accordance with the second embodiment of the present invention.

Each bed or table is layered, almost a sandwiched construction. The components are preferably made of aluminum because of its strength, light weight, and ability to withstand heat. A hollow, rectangular frame 20 along the edges (11, 12,13,14) gives the bed general structural support. Starting from the bottom, the lowest layer of the layered general construction is a bottom sheet forming the lower surface 21. This sheet is a thin 0.080" sheet metal (aluminum); the rectangular frame 20 is adhesively attached along the perimeter of the top surface of this bottom sheet. The frame has a thickness 1.5" (aluminum). The orifice 22 for attaching and receiving the vacuum line 23 is cut into this bottom sheet 21. The next layer is an air control layer 90 comprising a plurality of air channels, air ducts and air chambers, generally open at the top. This layer 30 will be discussed in detail for each of the embodiments disclosed. Above this is the perforated separation sheet 31. This thin sheet is approximately 0.080" of sheet metal (aluminum). The perforations 32 in this sheet are approximately 0.470" diameter, spaced about 1.5" apart from one another in one direction [e.g., vertical direction] and spaced about 0.750" apart from one another in the other direction [e.g., horizontal direction]. Above the perforated sheet 31 is the honeycomb support structure 33 for strengthening the top surface of the bed. The honeycombs are approximately 0.75" high and made of very thin metal (steel) and the walls are about 0.060" thick. Each honeycomb is a six sided structure; FIGS. 3 and 4 show the side walls of the honeycombs. Preferably, the honeycomb sidewalls do not block the perforations. In short, the perforations 32 in the separation sheet 31 preferably align with the openings [between the sidewalls of the honeycombs] in the honeycomb structure 33 so that air can pass through the honeycombs and the perforations 32.

Immediately above the honeycomb structure 33 is a top sheet or skin 25 forming the upper or top surface. This top sheet comprises a thin metal sheet, about 0.080" thick. The rectangular frame 20 is adhesively connected along the perimeter of the bottom surface of the top sheet 25 and the upper surface of the bottom sheet 21. The top sheet 25 has a plurality of holes 34 therein for permitting air therethrough. The holes 34 are approximately 0.050" diameter, smaller than the perforations 32 in the separation sheet 31, spaced about 1.5" apart from one another in one direction [e.g., vertical direction] and spaced about 0.750" apart from one another in the other direction [e.g., horizontal direction]. Preferably, the holes 34 align with the openings in the honeycomb structure 33 and generally align with the perforations 32 in the separation sheet 31 to permit air to communicate between and flow through the holes 34 and the perforations 32.

Each bed/table is ideally sealed so that the means for air to enter the bed is through the openings 34 in the top sheet 25 and the only means for air to exit the bed is through the line 23 to the vacuum. Thus, when the blower is turned on, air is drawn from above the table/bed through the holes in the top sheet, through the honeycomb support structure, through the perforations in the separation sheet, through the air control layer and through the orifice in the bottom sheet to the line for the vacuum. As a result, when the vacuum is turned on, a sheet resting on the top sheet will be drawn to and held on the top surface of the top sheet.

The above structure is generally maintained in all the embodiments. The primary variables that change are the configurations within the air control layer 30 and the location of the orifice 22 for the vacuum line 23 and the control knobs, levers and handles.

First Embodiment (The Set Adjustments Labyrinth 110)

Turning to FIGS. 1–4, the first embodiment 110 of the present invention is shown. This system gives the user "set"

sheet sizes, like a copy machine, e.g., 38"×50", 64"×80", 64"×146", etc. One adjustment controls the size and location of the vacuum zone in both the horizontal (H) and vertical (V) directions.

A primary vacuum tube 121 is positioned parallel and along the base 11 of the bed 110. The primary vacuum tube 121 is preferably a closed tube, rectangular or circular in cross section. This tube is in communications with the vacuum line 23. The orifice 22 for the vacuum line 23 can be located in the primary vacuum zone 120, defined as the area where there will always be a vacuum, even when the adjustment is for the smallest vacuum area. Two pistons 122 are positioned within the tube 121 and are connected to one another by conventional and well known means such that they move together (e.g., they simultaneously move towards one another and simultaneously move away from one another). Specifically, a lead screw 123 passes through each piston 122 and is connected at one end to a handwheel 124. As the handwheel 124 is rotated in one direction, the pistons 122 move within the tube 121 (see arrows A in FIG. 1) towards each other; when the handwheel 124 is rotated in the opposite direction, the pistons 122 move within the tube 121 away from each other.

The pistons within the primary tube are configured or contoured to fit snugly within the primary vacuum tube such that air or a vacuum created in the tube on one side of the pistons (the area between the pistons) will not pass through the piston to the portion of the tube located on other side of the pistons.

An indicator dial 125 is in communications, i.e., by meshed gearing, with the screw 123 so that when the screw is turned, the indicator will show the size of sheet the bed 110 is to support and also the size of the vacuum [zone] created on the table.

A plurality of air channels 130 or ducts are in communication with the primary vacuum tube 121 (FIG. 1). This is accomplished by the having holes 131 in the abutting wall of the tube 121 aligned with the channels 130 (FIG. 4). Each channel 130 is generally L-shaped (FIG. 1). They 130 are, however alternating directions such that each left facing L-channel 130*a* is sandwiched between two right facing L-shaped channels 130*b*.

As the handwheel 124 is rotated, the pistons 122 move, blocking a portion 121*a* of the primary vacuum tube 121 behind the pistons (the area that is not between the pistons), cutting off the air flow to this area, and vacuum generated, in the channels 130 connected behind the piston. Air still flows and a vacuum is still generated in the portion 121*b* of the vacuum tube 121 in front of the pistons 122 (identified as area 121*b*)(the area between the pistons) and the channels 130 in communication with that portion 121*b* of the tube. The position of the pistons in FIG. 1 show the pistons blocking the air flow and vacuum to the outer two channels 130*c* and 130*d*. The indicator would show the sheet sizes corresponding to the sizes of the vacuum zone created with the outer two channels, 130*c*,130*d* cut-off.

The channels 130 are U-shaped, opened at the top. The separation sheet 31 is positioned above the channels making them closed rectangular ducts for all practical purposes. The perforations 32 in the separation sheet 31 are positioned directly above the channels 130. Thus, the vacuum formed in one channel 130 will correspond to a vacuum forming in a vertical (V) column(s) of perforations 32 directly above the channel, and those column(s) of holes 34 directly above these perforations 32.

Above the perforations 32 in the separation sheet 31 are the cells for the honeycomb structure 33, which are, in essence, closed ducts between the separation sheet and the top sheet. Above the honeycomb walls are the small holes 34 or openings in the top surface 25 of bed 110. Thus air is drawn from above the table through the openings in the bed, through the cells in the honeycomb layer, through the perforations in the separation sheet and into the channel(s) in the air control layer 90.

Second Embodiment (The Strip Valves 210)

FIGS. 5–8 show the second embodiment 210 of the present invention. This system gives the user numerous options for both rectangular and square sheets. A few adjustments are necessary to control the vacuum zone in both the horizontal (H) and the vertical (V) directions. The system 210 comprises three primary components. A lower table 241, an upper table 242 and plurality of strip valves 240.

A vacuum line 23 is connected to the bottom of the lower table 241. The orifice 22 for the vacuum line can be located in the approximate center of the lower bed. The lower table has a frame (not shown) and an internal chamber 90. It can optionally also include a honeycomb support structure therein. There is a top separation sheet 31 to the lower table 242 with a plurality of perforations 32 therein.

The upper table/bed 242 is constructed similar to the lower table/bed 241 having top sheet 25 with a plurality of holes 34 therein, an internal chamber with a honeycomb support structure therein and a lower separation sheet 31 a with perforations 32*a* therein. When the upper table 242 and lower table 241 are aligned with one another in operation, the perforations 32*a* in the lower separation sheet 31*a* of the upper table 242 and perforations 32 in the top separation sheet 31 of the lower table 241 are aligned with one another. The holes 34 in the top sheet 25 of the upper table 242, the working surface, generally align with the perforations 32,32*a* in the lower and upper separation sheets 31,31*a*. The upper and lower tables 242,241 are connected by conventional and well known means 243 such as screws, bolts, adhesives, sleeves, etc.

Figure 6:
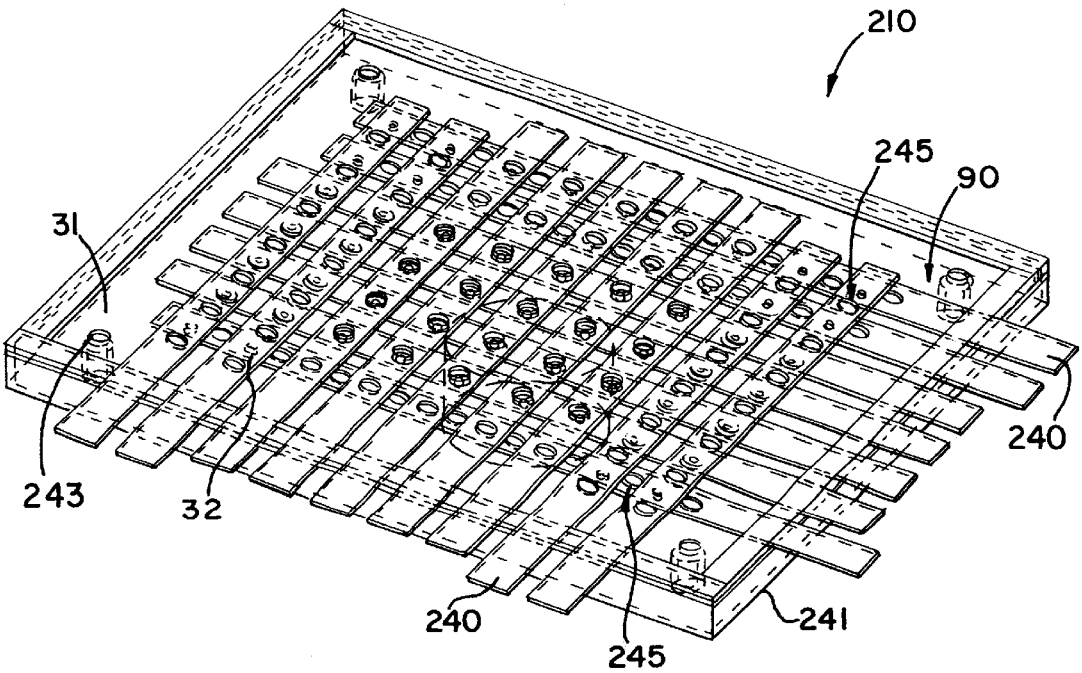
FIG. 6 is a schematic perspective view of the table of FIG. 5 with the upper surface and upper portion removed.
Figure 7:
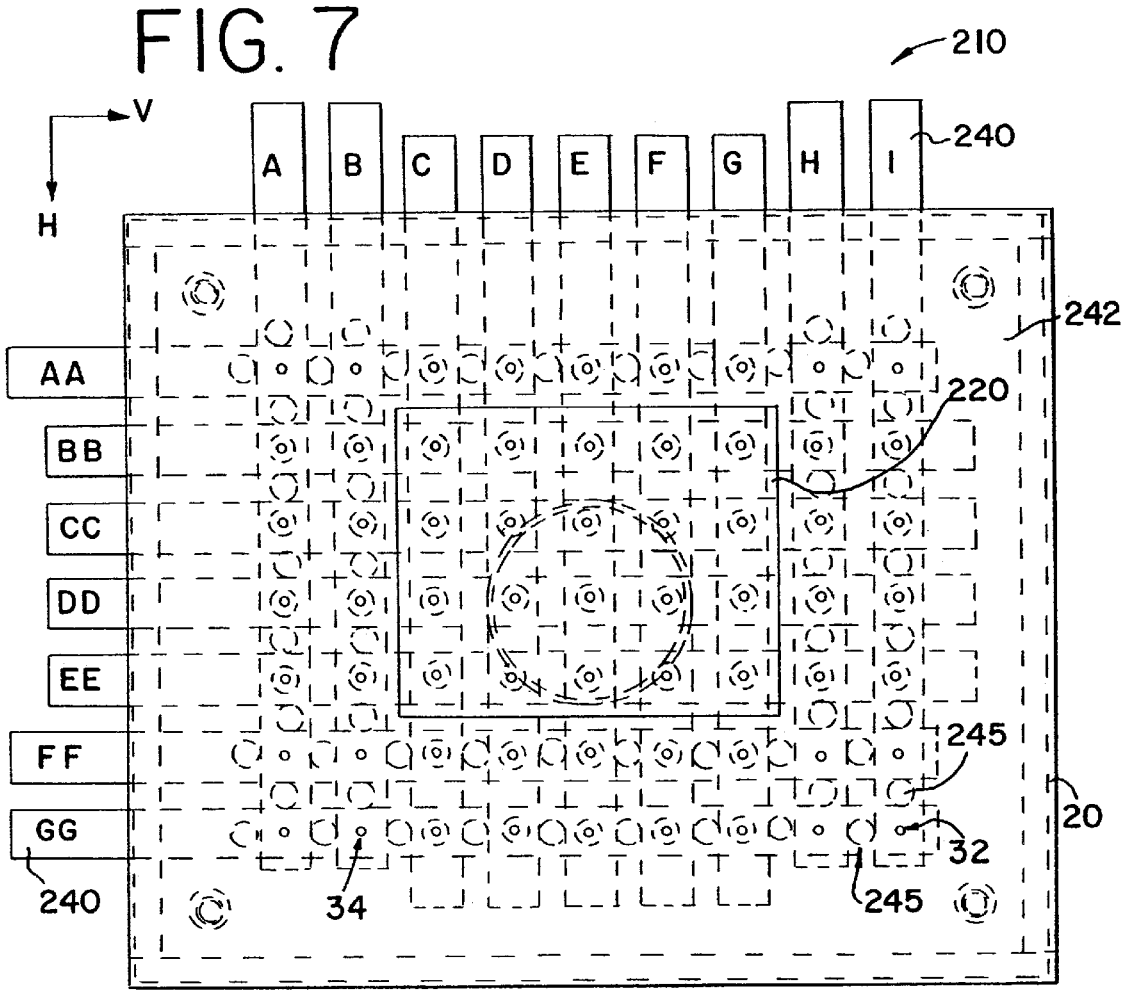
FIG. 7 is a top plan view of the of the table of FIGS. 4 and 5.
Figure 8:
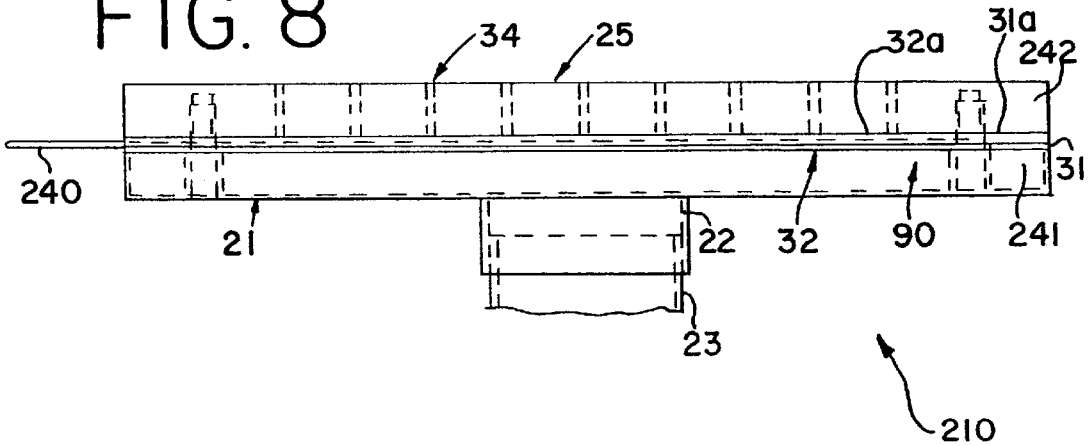
FIG. 8 is a side elevation view of the table of FIG. 7.

The system 210 incorporates a plurality of parallel strips 240, both the horizontal and vertical, that act as valves opening and closing air passageways to control both the size and location of the vacuum zone 220. The horizontal strips 240 (A–I) along the vertical axis act as horizontal gates and the vertical strips 240 (AA–GG) along the horizontal axis act as vertical gates (FIG. 7). The strips 240 are disposed between the upper table 242 and lower table 241 and more particularly, the lower separation sheet 31*a* of the upper table and the top separation sheet 31 of the lower table. Each valve 240 is a substantially flat strip with a plurality of collinear apertures 245 centrally located along the length thereof. The vertical strips are placed directly above the top sheet of the lower chamber and the vertical strips are positioned directly above the horizontal strips (FIG. 6). The gates have walls (not shown) between them and separating them that act like tracks or guides to prevent the gates from moving in a non-collinear direction, out of alignment, when moved between their "on" and "off" positions. In addition, the system is sealed to prevent unwanted ambient air from entering the system between the tables and gates. The strips are held in position so that they only move back and forth, and not side to side, by channels, grooves or curbs (not shown) adjacent to the strips. Bumpers (not shown can also be placed on the channels to prevent them from moving too far into or out of the assembly. Each gate has two positions, "on" and "off." In the "on" position, the apertures in the gate align with the perforations above and below the gate. Air can thus pass between the upper and lower tables and gate resulting in a vacuum forming between the blower and the hole(s) in the top sheet of the upper bed in communication with the perforations of the tables and apertures in the gate(s). See FIG. 5 wherein all the apertures are aligned—holes 34 in the top sheet 25, perforation 32*a* in the upper separation sheet 31*a*, perforation 32 in the lower separation sheet 31, aperture 245 in horizontal strip 240, and aperture 245 in vertical strip 240. In the "off" position, the apertures in the gate are not aligned (between) with the perforations. Air is blocked and cannot pass between the upper and lower tables and gate; no vacuum is formed between the blower and the hole(s) in the top sheet of the upper bed in communication with the perforations of the tables and apertures in the gate(s).

The vacuum zone 220 (shown in FIGS. 5 and 7) can be located, sized and adjusted by moving the horizontal and vertical gates into the on or off position. In the embodiment 210 shown, horizontal gates A, B, H and I and vertical gates AA, FF and GG are in the "off" position; horizontal gates C, D, E, F and G and vertical gates BB, CC, DD, and EE are in the "on" position. The intersection of the "on" apertures in the gates form a vacuum zone 220. In other words, the aligned open apertures wherein both the horizontal gates are in the "on" position and the vertical gates are in the "on" position create the vacuum zone 220 (a vacuum in the top surface). No vacuum is created in the holes outside the zone 220. Thus, a sheet having the surface area of zone 220 can be held on the top bed.

This zone 220 can be enlarged by turning "on" adjacent gates [e.g., horizontal gates B or H or vertical gates AA or FF] or reduced by turning "off" adjacent gates [e.g., horizontal gates C and G or vertical gates BB and EE]. In addition to controlling the size of the vacuum zone, the above technique can be used to change the location of the zone. Multiple vacuum zones can also be created by turning certain gates "on" and other gates "off." Markings on the top surface of the bed 25 and/or individual strips can assist in locating the vacuum zone.

Third Embodiment (The Moving Valves 310)

FIGS. 9–12 show the third embodiment 310 of the present invention with the top sheet and honeycomb structure removed. This system works with four (4) quadrant controls. The table 310 is broken down into four (4) quadrants and each quadrant is controlled by the combination of two (2) controls. With the four controls, a vacuum zone can be adjusted to the necessary size. Two adjustment controls control the vacuum zone in the horizontal direction and two adjustment controls control the zone in the vertical direction.

A primary vacuum tube 321 is positioned parallel and along the side edge 13 of the bed 310. The primary vacuum tube 321 is preferably a closed tube, rectangular or circular in cross section. This tube 321 is in communications with the vacuum line (not shown). The orifice for the vacuum line can be located in the primary vacuum zone 320 [that area where there will always be a vacuum, even when the adjustment is for the smallest vacuum area]. In the alternative, the tube is U-shaped, opened at the top. The separation sheet is positioned above the tube making it a closed rectangular duct for all practical purposes. The perforations (not shown) in the separation sheet 31 are positioned directly above the tube. Thus, the vacuum formed in the primary tube 321 will correspond to a vacuum forming in the column(s) of perforations above the tube and those holes directly above these perforations.

Two pistons 322 are positioned within the tube 321 and are each connected to a control handle 124 via an entrained belt, chain or cable 350. Each handle 324 can be adjusted independent of the other handle and controls half [in the vertical direction] of the entire vacuum bed, e.g., the upper half of the vacuum bed and the lower half of the vacuum bed. Thus, as the control handle 324 is slid in one direction, the piston 322 moves within the tube in the other, opposite direction. The pistons 322 within the primary tube 321 are configured or contoured to fit snugly within the vacuum tube such that air or a vacuum created in the tube on one side of the piston will not pass through the piston to the portion of the tube located on other side of the piston. An indicator or markings (not shown) on the side edge 13 of the bed 310 give an indication as to the size of the vacuum zone being created.

A plurality of horizontal air channels or ducts 330 are in communication with the primary vacuum tube 321. This is accomplished by the having holes in the abutting wall of the tube aligned with the channels (discussed in the first embodiment). Each channel 330 is generally straight and rectangular.

Figure 12:
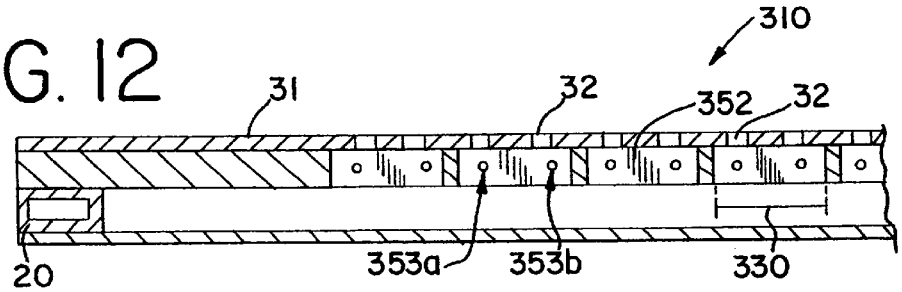
FIG. 12 is a sectional view along line 12—12 in FIG. 11.
Figure 12A:
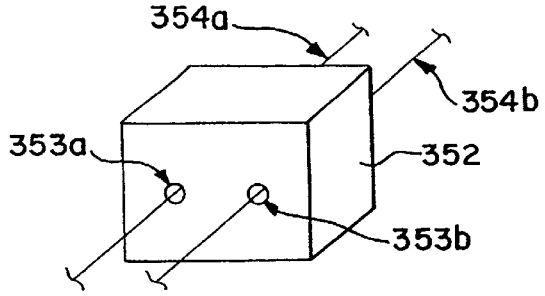
FIG. 12*a* is a detail drawing of a channel block.

As shown in FIG. 12, all of the horizontal channels 330 are U-shaped, opened at the top. The separation sheet 31 is positioned above the channels making them closed rectangular ducts for all practical purposes. The perforations 32 in the separation sheet 31 are positioned directly above the channels 330. Thus, the vacuum formed in one horizontal channel 330 will correspond to a vacuum forming in the row(s) of perforations 32 above the channel and those row(s) of holes in the upper sheet 25 directly above the these perforations 32.

Figure 9:
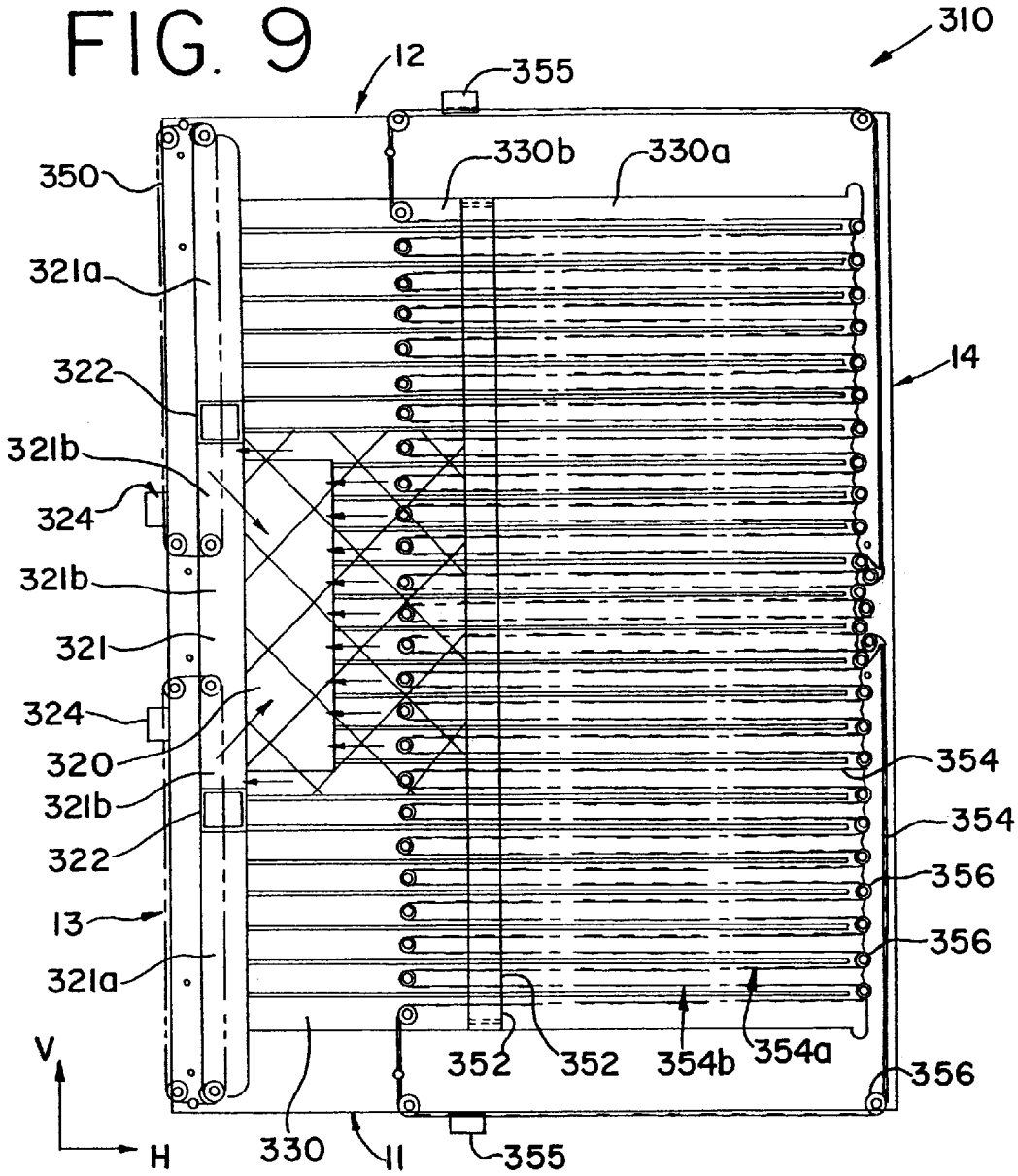
FIG. 9 is a top plan view of the table with the upper surface and upper portion removed and made in accordance with the third embodiment of the present invention.
Figure 10:
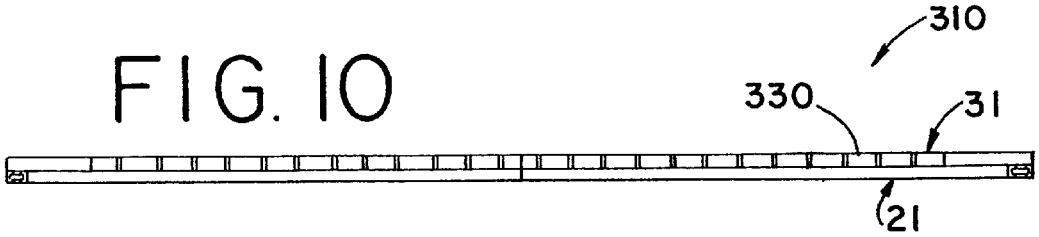
FIG. 10 is a side elevation view of the table of FIG. 9.
Figure 11:
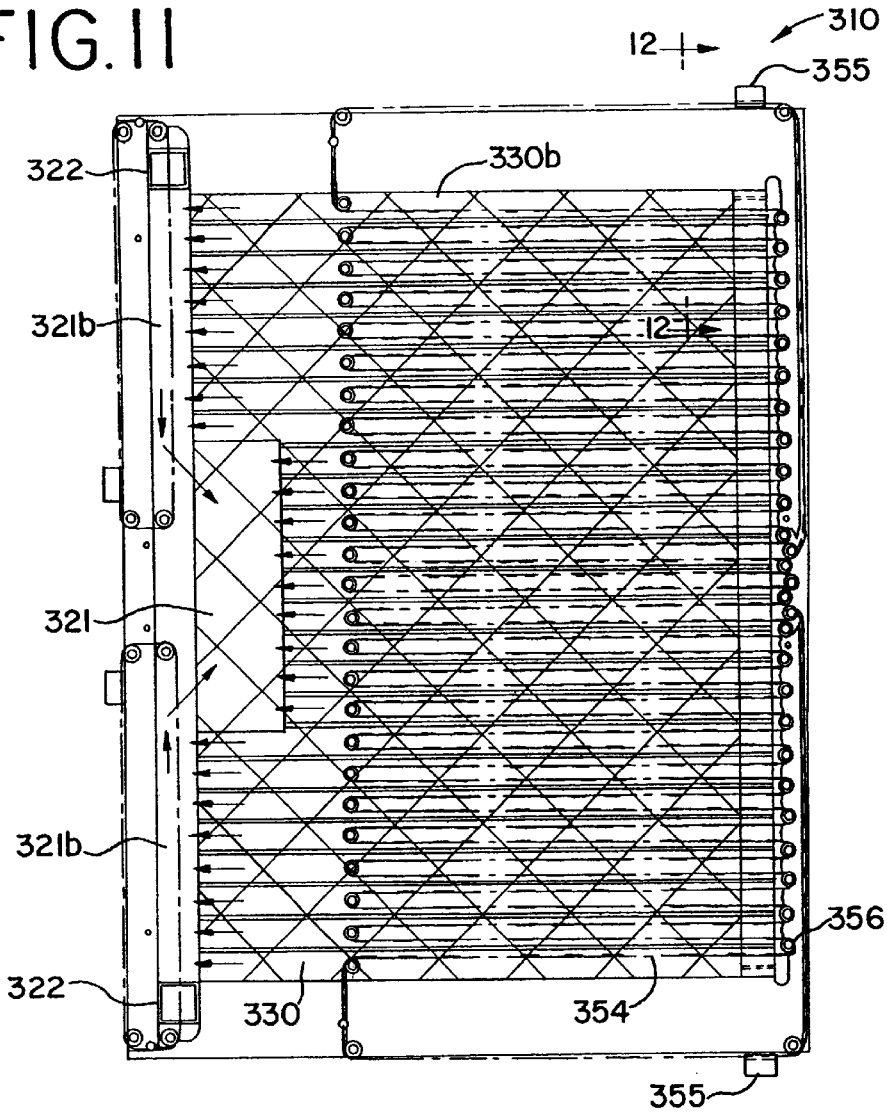
FIG. 11 is a top plan view of the table of FIG. 9 with different settings.

As the control handle 324 is slid, the piston 322 moves, blocking a portion 321*a* of the primary vacuum tube 321 behind the piston. This cuts off the air, and vacuum generated, in the channels 330 connected behind the piston. Air still flows and a vacuum is still generated in the portion 321*b* of the vacuum tube 321 in front of the piston 322 and the channels 330 in communication with that portion 321*b* of the tube. The position of the pistons 322 in FIG. 9 show the pistons blocking the air flow and vacuum to most of the horizontal channels 330. The position of the pistons 322 in FIG. 11 show the pistons not blocking any of the air flow to and vacuum on the horizontal channels 330.

In a similar manner, two control handles 351 control the vacuum zone in the horizontal direction. Specifically, a channel block 352 is positioned in each of the channels 330 (similar to the pistons described above). Each block is contoured to the internal shape of the channel 330 so that the block can both move in the channel and prevent air (or vacuum) from passing it. Each block 352 has two passageways 353*a*,353*b* therein for permitting cable(s) 354*a*,354*b* to pass through the block. One cable 354*a* is attached to the block 352. Each control handle 355 located along each of the horizontal edges (front and rear edges 11,12) controls half the vertically aligned blocks 352. In the figures, one control handle coordinates 12 aligned blocks and the other control handle controls 13 aligned blocks. The control handles 355 are positioned to be parallel with the blocks 352 they control. Thus, an indicator or scale along the front and rear edges 11,12 of the bed gives the user an indication of the position of the blocks. When the handle is moved to the left, the blocks controlled by it also move to the left.

A series of pulleys 356 and entrained cords 354 control and coordinate the movement of the blocks 352. The arrangement is generally shown in FIGS. 9 and 11. As noted above, each block 352 has two parallel passageways 353*a*, 353*b* passing through it parallel to the channel 330. The cord 354 connected to the control handle 355 is entrained around a series of first pulleys and a series of second pulleys. One cord 354*a* passing through the block is also attached to the block 352 so that when the control is slid, the block moves with the cord. All of the blocks can be controlled in this manner. The other cord 354*b* passing through the block is passed around a pulley at the end of the channel and is connected to the adjacent block. Thus, all of the blocks associated with a handle are connected to one another and can move together (e.g., they simultaneously move with one another).

As the control handle 325 is slid, the blocks 352 move, blocking a portion 330*a* of the channels behind the block, cutting off the air, and vacuum generated, in the that portion of the channels behind the blocks. Air still flows and a vacuum is still generated in the portion 330*b* of the channels 330 in front of the blocks 352. The position of the blocks 352 in FIG. 9 shows the blocks blocking the air flow and vacuum to most of length of each horizontal channel 330. The position of the blocks 352 in FIG. 11 show the blocks not blocking any of the air flow and vacuum in the horizontal channels 330.

FIG. 9, shows the vacuum bed having a very small vacuum zone 321 (shown by the crossed lines and airflow arrows). The pistons are in locations blocking off many of the outer horizontal channels and the blocks are at locations blocking off most of the length of the horizontal channels. Contrarily, FIG. 12 shows the vacuum bed having a very large vacuum zone 321 (shown also by the crossed lines and airflow arrows). The pistons are in locations exposing and opening up all the horizontal channels and the blocks are at locations opening up the full length of the horizontal channels.

As before, above the perforations 32 in the separation sheet 31 are the cells for the honeycomb structure. Above the honeycomb walls are the small holes or openings in the top surface of the flat bed. Thus air is drawn from above the table through the openings in the bed, through the cells in the honeycomb layer, through the perforations in the separation sheet and into the channel(s) or tube(s) in the air control layer.

Fourth Embodiment (The Stationary Valves 410)

Figure 13:
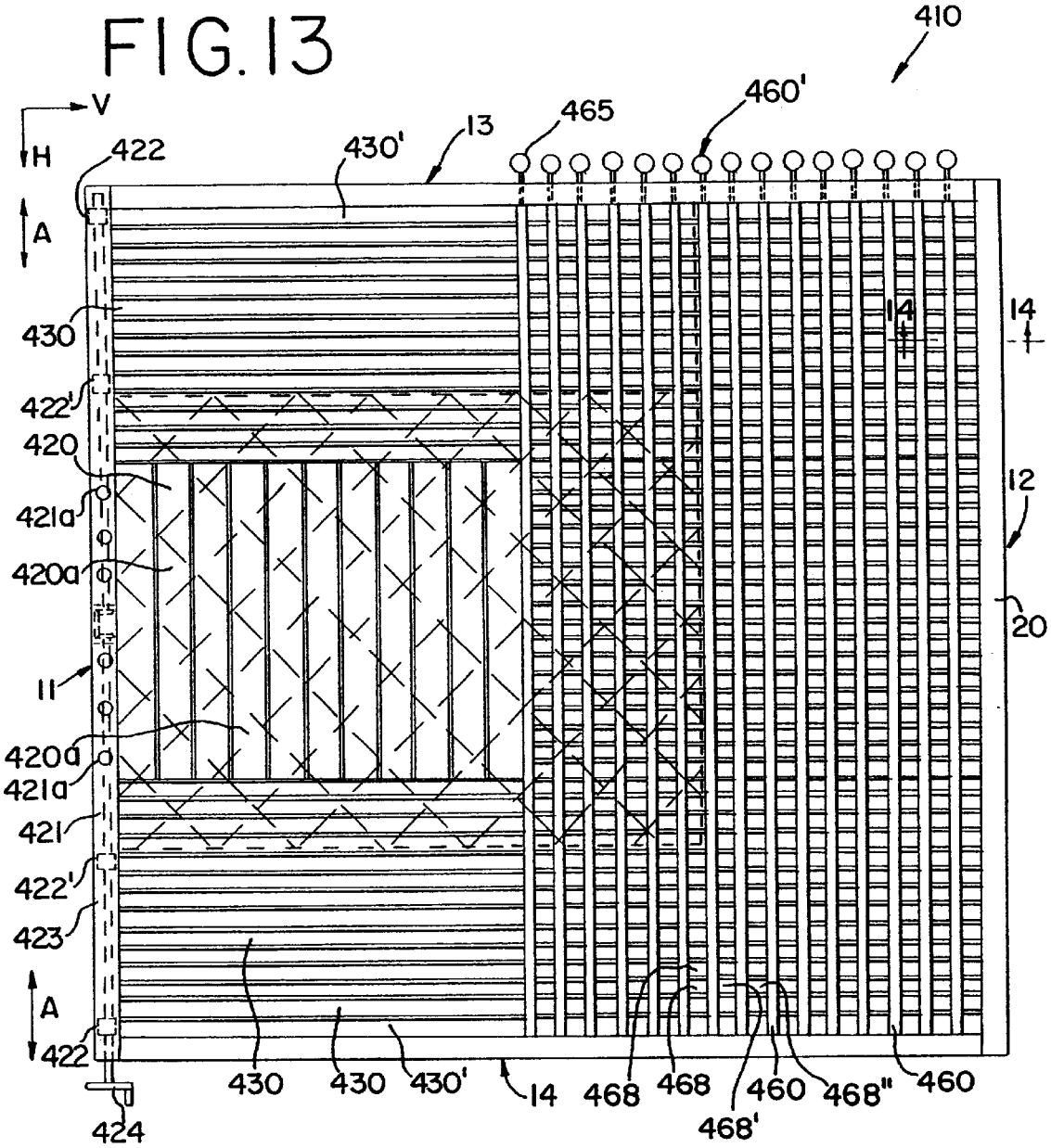
FIG. 13 is a top plan view of the table with the upper surface and upper portion removed and made in accordance with the fourth embodiment of the present invention.
Figure 14:
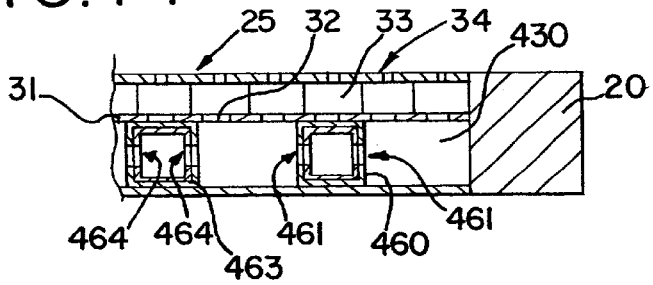
FIG. 14 is a sectional view along line 14—14 in FIG. 13.

FIGS. 13 and 14 shows the fourth embodiment 410 of the present invention with the top sheet and honeycomb structure removed. This system works with both a horizontal zone control and a vertical zone control.

The vertical zone control is similar to those discussed above in connection with the first embodiment 110 and the third embodiment 310. A plurality of parallel vertical air channels 430 or ducts are in communication with the primary vacuum tube 421. This is accomplished by having holes in the abutting wall of the tube aligned with the channels. Each channel 430 is generally straight and rectangular.

A primary vacuum tube 421 is positioned parallel and along the base 11 of the bed 410. The primary vacuum tube 421 is preferably a closed tube, rectangular or circular in cross section. This tube is in communications with the vacuum line 23 (not shown). The orifice (not shown) for the vacuum line can be located in the primary vacuum zone 420 defined as the area where there will always be a vacuum, even when the adjustment is for the smallest vacuum area. In FIG. 13, several horizontal channels are shown 420*a*, an area always having a vacuum 420. In an alternative embodiment, these channels 420*a* are vertical channels 430 like those around them. In this alternative presentation, the primary vacuum tube 421 has openings 421 a in the bottom thereof for communicating with the vacuum. Two pistons 422 are positioned within the tube 421 and are connected to one another by conventional and well known means such that they move together (simultaneously move towards one another and simultaneously move away from one another). Specifically, a lead screw 423 passes through each piston 422 and is connected at one end to a handwheel 424. As the handwheel 424 is rotated in one direction, the pistons 422 move within the tube 421 (see arrows A in FIG. 13) towards each other; when the handwheel 424 is rotated in the opposite direction, the pistons 422 move within the tube 421 away from each other.

As before, the pistons within the primary tube are configured or contoured to fit snugly within the primary vacuum tube such that air or a vacuum created in the tube on one side of the pistons (the area between the pistons) will not pass through the piston to the portion of the tube located on the other side of the pistons.

An indicator dial (not shown) is in communications, i.e., by meshed gearing, with the screw 423 so that when the screw is turned, the indicator will show the size of sheet the bed 410 is to support and also the size of the vacuum [zone] created on the table.

A plurality of air channels 430 or ducts are in communication with the primary vacuum tube 421. This is accomplished by the having holes (not shown) in the abutting wall of the tube 421 aligned with the channels 430.

As the handwheel 424 is rotated, the pistons 422 move, blocking a portion of the primary vacuum tube 421 behind the pistons (the area that is not between the pistons), cutting off the air flow to this area, and vacuum generated, in the channels 430 connected behind the piston. Air still flows and a vacuum is still generated in the portion of the vacuum tube 421 in front of the pistons 422 (the area between the pistons) and the channels 430 in communication with that portion of the tube. The position of the pistons in FIG. 13 show the pistons blocking off air flow and the vacuum to only the outermost channels 430'. The indicator would show the sheet sizes corresponding to the sizes of the vacuum zone created by this adjustment and arrangement.

The channels 430 are U-shaped, opened at the top. The separation sheet 31 is positioned above the channels making them closed rectangular ducts for all practical purposes. The perforations 32 in the separation sheet 31 are positioned directly above the channels 430. Thus, the vacuum formed in one channel 430 will correspond to a vacuum forming in a horizontal row(s) (H) of perforations 32 directly above the channel, and those row(s) of holes (not shown) directly above these perforations 32.

A plurality of transverse parallel gates or sleeves 460 are disposed within the channels 430. As shown in the section view of FIG. 14, these gates 460 are elongated, hollow sleeves [rectangular or circular] with opposed openings 461 therein. An elongated core 463 contoured to the inner surface of the sleeve [e.g., round or rectangular] is slidably mounted or seated within each sleeve 460. Each core 463 has a passageways 464 therein capable of alignment with the opposed openings 461 within the sleeve 460. In FIG. 14, the core 463 is shown as a hollow member with two opposed openings 464 therein. This core 463 may also be an elongated solid piece, such as extruded plastic, with parallel passageways 463 drilled transversely through the core 463. Either design of the core 463 must be capable of sliding within the sleeve 461 and either passing air through the core and sleeve or blocking air through the core and sleeve.

At an end of each core, there is a control knob 465. The control knob 465 has two positions, "on" and "off." By turning the control 465, the core 463 connected to it [by conventional and well known means], slides within the sleeve/gate 460. The control knob 465 includes an indicator marked "on" or "off" or, in the alternative, "open" or "closed." In the "on" or "open" position, the passageway [or opposed openings] 464 in the core 463 is aligned with the opposed openings 461 in the sleeve 460 permitting air, and hence a vacuum, to pass through the gate 460 within the channels 430 disposed on each side of the gate. In the "off" or "closed" position, the passageway 464 in the core 463 is not aligned with the opposed openings 461 in the sleeve 460 preventing air, and hence a vacuum, from passing through the gate 460 from the channels 430 closest to the vacuum to the channels on the other side of the gate 430.

Thus, turning to FIG. 13, in the positions shown, the vacuum zone 420 would extend virtually the entire size, within the frame 20 of the bed 410. If the pistons were moved to position 422' and the gate 460' was turned to the "off" position, the vacuum zone 420' would be the within the dotted lines shown (also with faint cross-hatching).

In the preferred construction, the vertical channels are not unitary or one piece constructions. The sleeves/gates 460 are first placed and secured (by an adhesive) on the bottom sheet 21 and channel segments 468 [U-shaped troughs/channels) are then inserted between the gates. The channel segments 468 are vertically aligned (in the V direction) 468',468" to form a single vertical channel 430.

As before, above the perforations 32 in the separation sheet 31 are the cells for the honeycomb structure 33. Above the honeycomb walls 33 are the small holes or openings 34 in the top surface 25 of the flat bed. Thus air is drawn from above the table through the openings 34 in the bed 25, through the cells in the honeycomb layer 33, through the perforations 32 in the separation sheet 31 and into the channel(s) 430 or tube(s) 421 in the air control layer. From here the air is drawn through the air hose to the vacuum pump.

Figure 14A:
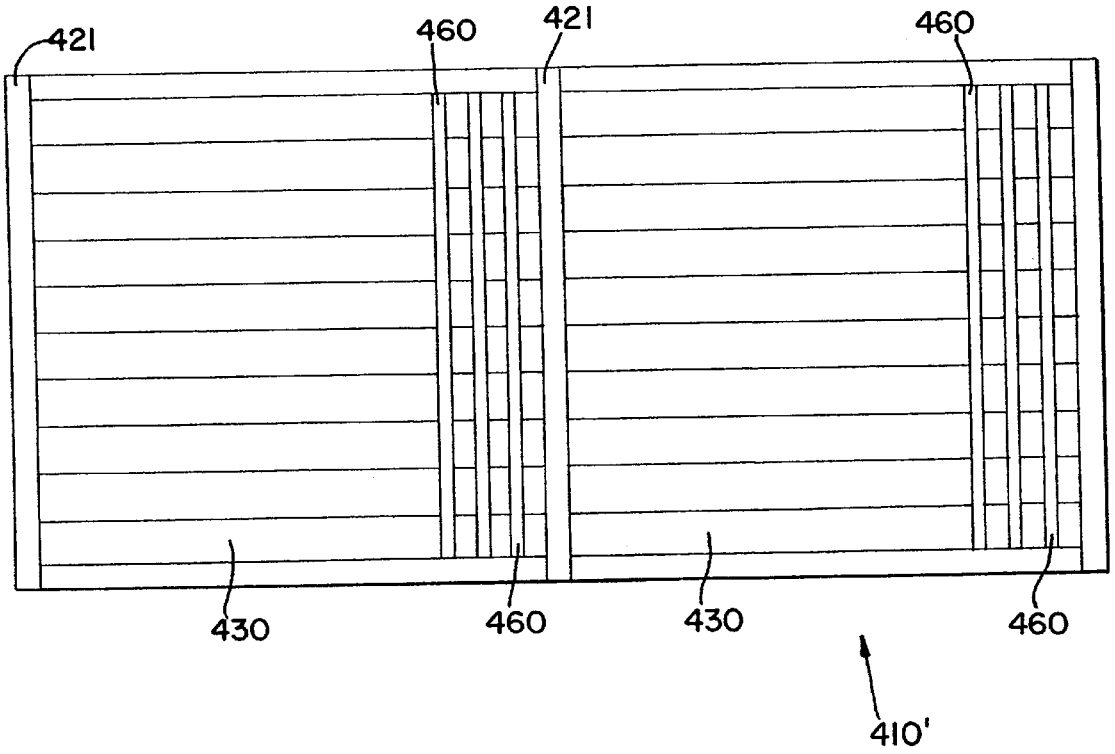
FIG. 14*a* is a schematic view of a very long table made pursuant to the fourth embodiment.

Finally, as shown in the schematic of FIG. 14*a*, in a very long table 410', one having a significant vertical dimension (V), the table shown can be constructed with two parallel vacuum tubes 421 controlling the vacuum along the horizontal direction and two sets of channels 430 and gates 460.

Fifth Embodiment (The Flexible Hose 510)

Figure 15:
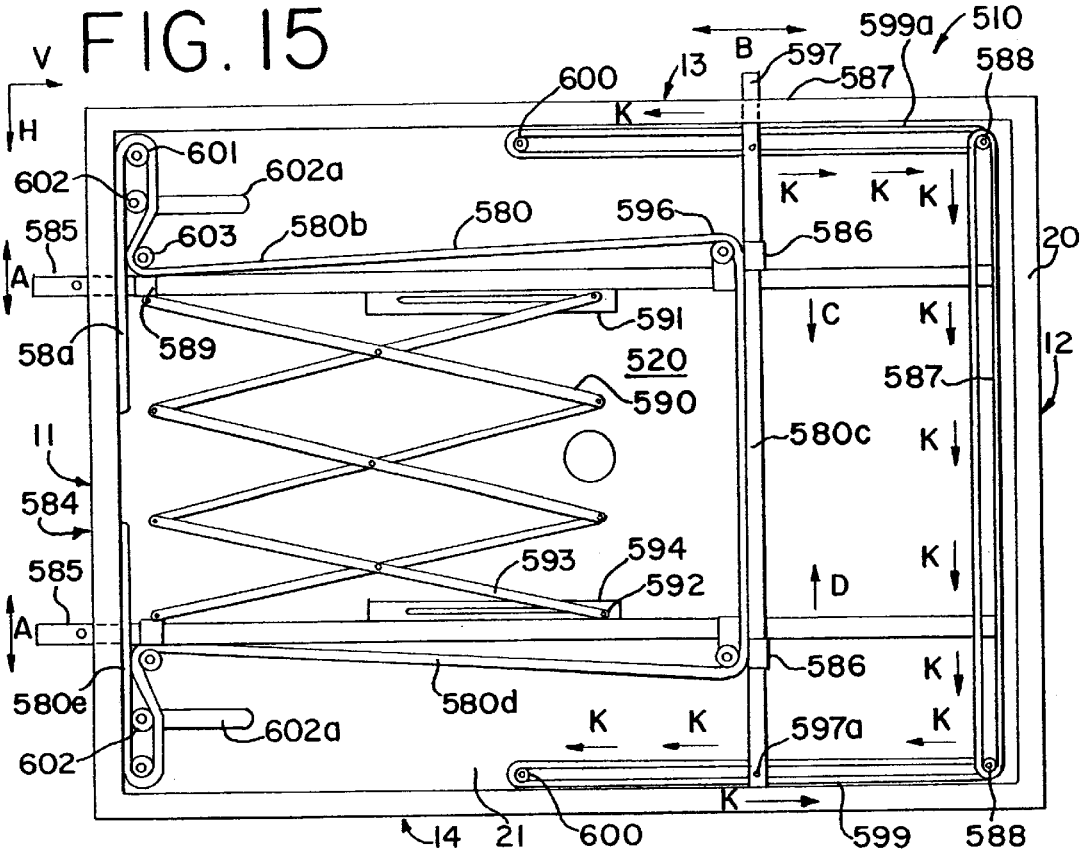
FIG. 15 is a top plan view of the table with the upper surface and upper portion removed and made in accordance with the fifth embodiment of the present invention; and, FIG. 16 is a top plan view of the table of FIG. 15 with different settings.
Figure 16:
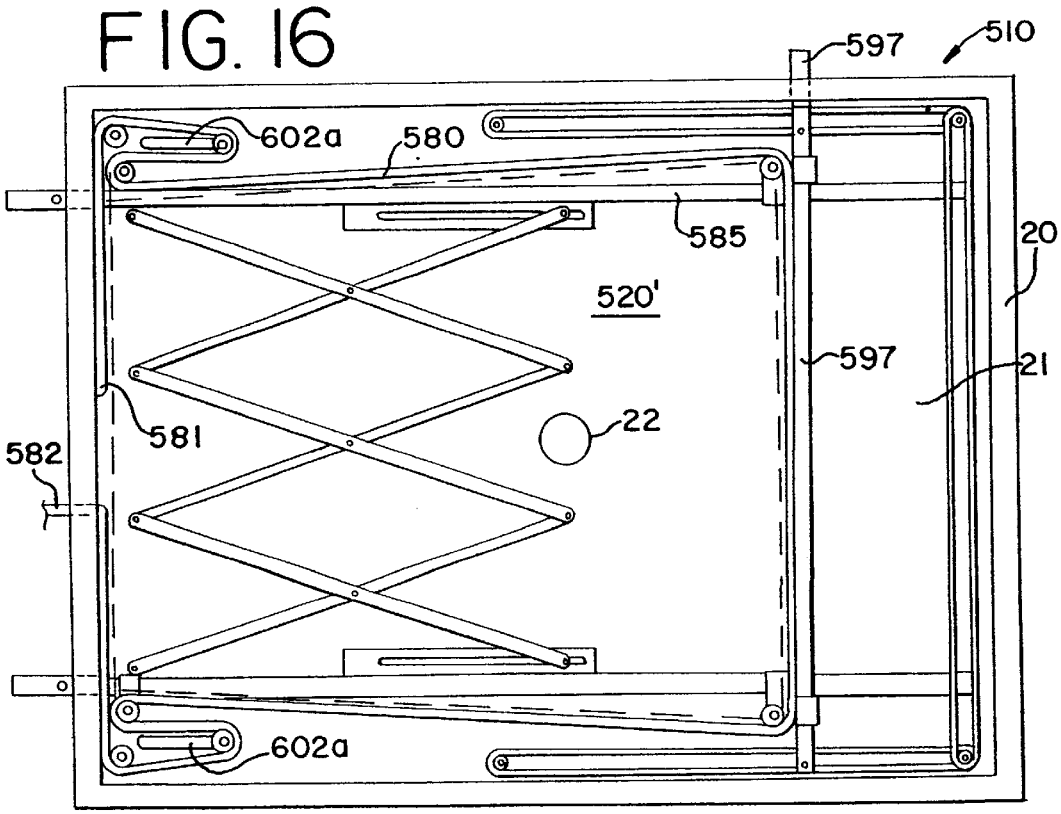

The fifth embodiment 510 is shown in FIGS. 15 and 16 with the top sheet, honeycomb structure and the perforated separation sheet removed. The air control layer comprises a flexible air hose 580, mechanisms for supporting the horizontal and vertical position of the hose and means to control these mechanisms. The hose disposed in the control layer 30 is manipulated by a plurality of handles while in the unfilled, empty state to the desired position or location and to the desired size of the vacuum zone. Once located and in place, the hose is inflated to seal off the area and air flow between the desired zone wherein the vacuum is desired and the zone outside this desired zone.

The air hose 580 is set up in the control layer 30 between the lower layer 21 and the perforated separation sheet (not shown). The location of the orifice 22 for the vacuum line (not shown) is in a location where a vacuum is always desired. The air hose 580, preferably constructed of a ⅝" (outside diameter) flexible rubber hose is totally sealed at one end 581 and attached to a conventional and well known inflating source (not shown), such as a small compressor, at the other end 582. As shown in the figures, the hose is manipulated so that a "closed" rectangle is formed. The area within this closed rectangle is the vacuum zone 520,520' and the area outside this zone is void of any vacuum. The size and location of the rectangle formed by the tube 580 is controlled by several controls and internal links.

At the base 11 of bed 510 two handles 585 are located. Each handle 585 is passed through a slot 584 within the frame 20 and extends vertically (V direction) well inside the bed wherein the distal end is free. There is an exposed portion of each handle 585 projecting outwardly from the bed and a portion within the frame 20, and as each handle 585 is moved, it is kept straight and vertical, as opposed to angled or inclined. In short, the handles are maintained parallel to one another. Each handle 585 is slid within the slot 584 and moved in the horizontal direction (Arrows A in FIG. 15). The handles can, if desired, be connected such that if one handle 585 (the upper handle in FIG. 15) is moved in one direction (direction C), the other handle (the lower handle in FIG. 15) moves in the other direction (direction D).

The handles 585 are further pivotably connected (connection brackets 589) to internal cross braces 590. The ends of the braces 590 opposite the end connected to the handles 585 have guides 592 that ride within tracks or slots 593 formed in the side brackets 594 connected to the handles 585. This stabilizes the handles 585 and ensures they remain vertical and parallel to one another.

At least one horizontally projecting handle 597 is also provided which also has a portion extending outwardly from the bed and a portion projecting horizontally well within the bed 510. This second handle 597 is slid within a slot 587 cut into the frame 20 or formed above the frame to permit the handle to move in the vertical direction (Arrows B in FIG. 15). As with the vertical handles 585, the horizontal handle 597 passed through a slot 587 and extends horizontally (H direction) well inside the bed wherein the distal end 597*a* is connected to a stabilizing chain/cord 599 to ensure that the handle 597 is maintained horizontal (parallel to the front and rear edges 11,12). As a result, there is an exposed portion of each handle 597 and a portion within the frame 20, and as the handle 597 is moved, it is kept straight and horizontal, as opposed to angled or inclined. The stabilizing chain 599*a* connects to the horizontal handle 597 adjacent the slot 587 to further ensure horizontal positioning of the handle 597. Both chains 599,599*a* are entrained around two sprockets or pulleys 588,600. Chain 587 is entrained around pulley/sprockets 588. Thus, when the horizontal handle 597 is moved, both chain 599*a* and interconnecting chain 587 move around their sprockets/pulleys 588,600 resulting in the smooth movement of the entire handle. The arrows K in FIG. 15 show the interconnected chains' 599,599*a*,587 movement.

The vertical handles 585 and horizontal handle 597 are slidably connected to one another by brackets 586. The brackets 586 permit the handles 585,597 to slide therein (e.g., the vertical handle 585 can slide relative to the horizontal handle 597 and the horizontal handle 597 can slide relative to the vertical handle 585) but ensure the handles are maintained at right angles (90°) to one another. Each bracket 586 further supports a pulley 596 to permit the tube 580 to move relative to the bracket.

A plurality of internal pulleys or roller 601,602,603 guide the hose 580 as it is moved within the bed 510. This prevents the hose 580 from getting tangled or becoming overlapped as it is moved, inflated and deflated. Specifically, the center roller 602 is positioned in a channel 602*a* adjacent the bottom sheet 21 and either biased in the channel (towards the horizontal handle 597) or connected by cable to the chains 599,599*a* so that the roller 602 moves. This permits the positioning of the roller 602 to change and pick up any "slack" in the hose 580 (See FIGS. 15 and 16). Separate rollers 603 are connected to brackets 589 secured to the vertical handles 585. These rollers 603 move with the handles 585. The outermost rollers 601 are attached to the bottom sheet 21.

The mechanics of the embodiment are as follows. While the hose is deflated, the vertical handles 585 are moved. FIG. 16 shows the handles 585 being moved outwardly from their position in FIG. 15. The horizontal handle 597 is similarly moved. FIG. 16 shows the horizontal handle 597 being moved away from the base 11 from its position in FIG. 15. Once in the desired position, the air is turned on leading to the tube 580 and the tube inflates. The rectangle formed by the inflated tube is the perimeter of the vacuum zone 520 (FIG. 15). The vacuum zone 520' is shown in dashed lines in FIG. 16.

For ease of use, the edges 11,12,13 include indicators thereon for advising the user of the positions of the handles 585,597 and the size of the article on the bed 21.

Once inflated, the tube seals the bed 510. In particular, the tube expands to seal the space between the lower layer 21 and the perforated separation sheet 31. Air is drawn from above the table through the openings 34 in the bed 25, through the cells in the honeycomb layer 33, through the perforations 32 in the separation sheet 31 and into the vacuum zone 521 formed within the perimeter of the tube 580. From here the air is drawn through the air hose to the vacuum pump.

While the specific embodiments have been illustrated and described, numerous modifications can be made without significantly departing from the spirit of the invention, and the scope of protection is only limited by the scope of the accompanying Claims.

What is claimed is:

1. A table for holding an article thereon comprising:

a table body including a top sheet having opposed sides and opposed ends, a bottom sheet spaced apart from and below the top sheet and forming a vacuum chamber between the bottom sheet and the top sheet, a separation and support structure disposed between the top sheet and the bottom sheet and above the vacuum chamber with a vacuum source in communications therewith and a plurality of holes through the top sheet, the plurality of holes for drawing air defining a vacuum zone having both a width and a height, wherein air drawn through the holes in the top sheet passes through the openings in the separation and support structure; and, means within the table to adjust the width and height of the vacuum zone.

2. The vacuum bed of claim 1 wherein the means within the table to adjust the width and height of the vacuum zone also adjusts the position of the vacuum zone.

3. A vacuum bed for holding a substrate thereon comprising:

a top sheet having a plurality of holes therein;

a bottom sheet spaced apart from and below the top sheet forming a vacuum chamber between the bottom sheet and the top sheet;

a separation sheet with perforations therein disposed between the top sheet and the bottom sheet and above the vacuum chamber;

a vacuum source in communication with the vacuum chamber adapted to draw air through the holes, the aggregate of holes drawing air defining a vacuum zone to hold the substrate on the top sheet and to the top sheet; and means within the vacuum chamber to control and adjust the size of the vacuum zone created on the top sheet to hold substrates of different sizes.

4. The vacuum bed of claim 3 further including a honeycomb support structure with openings therein disposed between the top sheet and the bottom sheet and above the separation sheet.

5. The vacuum bed of claim 4 wherein air drawn through the holes in the top sheet pass through the openings in the honeycomb support structure and through the perforations in the separation sheet.

6. A vacuum bed for holding a substrate thereon comprising:

a top sheet having a plurality of holes therein;

a bottom sheet spaced apart from and below the top sheet forming a vacuum chamber between the bottom sheet and the top sheet;

a vacuum source in communication with the vacuum chamber adapted to draw air through the holes, the aggregate of holes drawing air defining a vacuum zone to hold the substrate on the top sheet and to the top sheet; and means within the vacuum chamber to control and adjust the size of the vacuum zone created on the top sheet to hold substrates of different sizes, said means within the vacuum chamber comprising a means for controlling and adjusting both the height and the width of the vacuum zone.

7. The vacuum bed of claim 6 wherein the means for controlling and adjusting both the height and the width of the vacuum zone includes a plurality of L-shaped channels in communications with a primary vacuum tube.

8. The vacuum bed of claim 7 further including at least two pistons moveable within the primary vacuum tube to block a air from being drawn through select L-shaped channels.

9. The vacuum bed of claim 8 wherein the pistons are interconnected to one another.

10. The vacuum bed of claim 9 wherein the pistons are connected to one another by a screw such that they simultaneously move towards one another or away from one another.

11. The vacuum bed of claim 6 wherein the means within the vacuum chamber to control and adjust the size of the vacuum zone comprises:

a plurality of vertical gates with apertures therein and horizontal gates with apertures therein, each gate movable between an open position wherein air can flow between the vacuum chamber and the top sheet and a closed position wherein air is prevented from flowing between the vacuum chamber and the top sheet.

12. The vacuum bed of claim 11 wherein each gate is a substantially flat stip with a plurality of collinear apertures therein.

13. The vacuum bed of claim 12 wherein the vertical gates are parallel to one another and the horizontal gates are parallel to one another.

14. The vacuum bed of claim 13 wherein in the open position the apertures in the gate are aligned with the perforations in the separation adjacent the gate and the holes in the top sheet.

15. The vacuum bed of claim 14 wherein each gate can be independently set to open or closed and both the location and the size of the vacuum zone can be set.

16. The vacuum bed of claim 6 wherein the means within the vacuum chamber to adjust the size of the vacuum zone comprises:

a means for controlling and adjusting the width of the vacuum zone; and, a separate means for controlling and adjusting the height of the vacuum zone.

17. The vacuum bed of claim 16 wherein the means for controlling and adjusting the height of the vacuum zone includes a plurality of horizontal channels in communications with a vertical primary vacuum tube.

18. The vacuum bed of claim 17 further including at least two pistons moveable within the primary vacuum tube to block air from being drawn through select channels.

19. The vacuum bed of claim 18 wherein the pistons are independent of one another.

20. The vacuum bed of claim 19 wherein the means for controlling and adjusting the width of the vacuum zone includes a plurality of blocks with at least one in each channel that are movable within the channels.

21. The vacuum bed of claim 20 wherein the blocks are interconnected to one another such that by moving one block other blocks move with that one block.

22. The vacuum bed of claim 21 wherein the blocks are connected to one another by cables entrained around pulleys.

23. The vacuum bed of claim 22 wherein four control handles adjacent the bed control the location and the size of the vacuum zone, two handles controlling the position of the pistons with each handle connected to a piston and two handles controlling the blocks with each handle connected to approximately half the blocks.

24. The vacuum bed of claim 18 wherein the means for controlling and adjusting the width of the vacuum zone includes a plurality of parallel gates transversing the parallel channels, each gate movable between an open position wherein air flowing in the channel can pass through the gate and between the vacuum chamber and the top sheet and a closed position wherein air is prevented from flowing through the gate to the top sheet.

25. The vacuum bed of claim 24 wherein each gate is a hollow sleeve with opposed openings therein and a core slidably positioned within the sleeve having passageways therein.

26. The vacuum bed of claim 25 wherein in the open position the passageways within the core are aligned with the openings in the sleeve.

27. The vacuum bed of claim 26 wherein each gate can be independently set to open or closed and both the location and the size of the vacuum zone can be set.

28. The vacuum bed of claim 16 wherein the means within the vacuum chamber to control and adjust the size of the vacuum zone includes a hose positioned within the vacuum chamber that can inflated and deflated.

29. The vacuum bed of claim 28 further including at least one handle adjacent the bed for positioning the horizontal boundaries of the hose.

30. The vacuum bed of claim 29 further including at least one handle adjacent the bed for positioning the vertical boundaries of the hose.

31. The vacuum bed of claim 30 further including a plurality of handles adjacent the bed connected to the hose at different locations for positioning both the horizontal and vertical boundaries of the hose.

32. A vacuum bed for holding an article thereon comprising:

a top sheet having opposed sides and opposed ends and a plurality of holes therein;

a bottom sheet spaced apart from and below the top sheet and forming a vacuum chamber between the bottom sheet and the top sheet;

a vacuum source in communications with the vacuum chamber adapted to draw air through the holes, the collection of holes drawing air defining a vacuum zone having both a width and a height to hold the article on the top sheet;

means within the vacuum chamber to control and adjust the width and height of the vacuum zone wherein the means within the vacuum chamber to control and adjust the width and height of the vacuum zone also controls and adjusts the position of the vacuum zone; and a separation sheet with perforations therein disposed between the top sheet and the bottom sheet and above the vacuum chamber and a honeycomb support structure with openings therein disposed between the top sheet and the bottom sheet and above the separation sheet and air drawn through the holes in the top sheet pass through the openings in the honeycomb support structure and through the perforations in the separation sheet.

33. The vacuum bed of claim 28 wherein the means within the vacuum chamber to adjust the size of the vacuum zone comprises:

a means for controlling and adjusting both the height and the width of the vacuum zone.

34. The vacuum bed of claim 33 wherein the means for controlling and adjusting both the height and the width of the vacuum zone includes a plurality of L-shaped channels in communications with a primary vacuum tube and at least two pistons moveable within the primary vacuum tube to block a air from being drawn through select L-shaped channels.

35. The vacuum bed of claim 32 wherein the means within the vacuum chamber to control and adjust the size of the vacuum zone comprises:

a plurality of vertical gates with apertures therein and horizontal gates with apertures therein, each gate movable between an open position wherein air can flow between the vacuum chamber and the top sheet and a closed position wherein air is prevented from flowing between the vacuum chamber and the top sheet.

36. The vacuum bed of claim 35 wherein each gate is a substantially flat stip with a plurality of collinear apertures therein, the vertical gates being parallel to one another and the horizontal gates being parallel to one another and in the open position the apertures in the gate being aligned with the perforations in the separation adjacent the gate and the holes in the top sheet.

37. The vacuum bed of claim 36 wherein each gate can be independently set to open or closed and both the location and the size of the vacuum zone can be set.

38. A vacuum bed for holding an article thereon comprising:

a top sheet having opposed sides and opposed ends and a plurality of holes therein;

a bottom sheet spaced apart from and below the top sheet and forming a vacuum chamber between the bottom sheet and the top sheet;

a vacuum source in communications with the vacuum chamber adapted to draw air through the holes, the collection of holes drawing air defining a vacuum zone having both a width and a height to hold the article on the top sheet; and;

means within the vacuum chamber to control and adjust the width and height of the vacuum zone, said means within the vacuum chamber to control and adjust the width and height of the vacuum zone comprising a means for controlling and adjusting the width of the vacuum zone and a separate means for controlling and adjusting the height of the vacuum zone, wherein said means for controlling and adjusting the height of the vacuum zone includes a plurality of horizontal channels in communications with a vertical primary vacuum tube and at least two pistons moveable within the primary vacuum tube to block air from being drawn through select channels.

39. The vacuum bed of claim 38 wherein the means for controlling and adjusting the width of the vacuum zone includes a plurality of blocks with at least one in each channel that are movable within the channels, the blocks being interconnected to one another such that by moving one block other blocks move with that one block.

40. The vacuum bed of claim 39 wherein four control handles adjacent the bed control the location and the size of the vacuum zone, two handles controlling the position of the pistons with each handle connected to a piston and two handles controlling the blocks with each handle connected to approximately half the blocks.

41. The vacuum bed of claim 38 wherein the means for controlling and adjusting the width of the vacuum zone includes a plurality of parallel gates transversing the parallel channels, each gate movable between an open position wherein air flowing in the channel can pass through the gate and between the vacuum chamber and the top sheet and a closed position wherein air is prevented from flowing through the gate to the top sheet.

42. The vacuum bed of claim 41 wherein each gate is a hollow sleeve with opposed openings therein and a core slidably positioned within the sleeve having passageways therein and in the open position the passageways within the core are aligned with the openings in the sleeve.

43. The vacuum bed of claim 42 wherein each gate can be independently set to open or closed and both the location and the size of the vacuum zone can be set.

44. The vacuum bed of claim 32 wherein the means within the vacuum chamber to control and adjust the size of the vacuum zone includes a hose positioned within the vacuum chamber that can inflated and deflated, at least one handle adjacent the bed for positioning the horizontal boundaries of the hose and at least one handle adjacent the bed for positioning the vertical boundaries of the hose.

45. The vacuum bed of claim 44 further including a plurality of handles adjacent the bed connected to the hose at different locations for positioning both the horizontal and vertical boundaries of the hose.

46. A vacuum table for holding an article thereon, the vacuum table comprising:

a top sheet for supporting an article, the top sheet having a shape defined by a peripheral edge, the top sheet comprising a plurality of holes adapted for transferring a fluid pressure;

a vacuum zone comprising a primary zone and a variable zone, the primary zone extending outwardly from a baseline located adjacent a portion of the peripheral edge and receiving the fluid pressure and defined by a predetermined pattern of the plurality of holes, the primary zone having an outer perimeter defining a minimum area of the vacuum zone, the variable zone being adapted for selectively receiving the fluid pressure, the variable zone comprising a remaining portion of the plurality of holes extending outwardly in a plurality of predetermined incremental patterns from a portion of the outer perimeter of the primary vacuum zone; and a vacuum source for providing the fluid pressure to the vacuum zone and including a primary vacuum passage having a mechanical regulator therein for selectively restricting delivery of the fluid pressure to the variable zone.

47. The vacuum table of claim 46 further comprising a bottom sheet spaced from the top sheet by a vacuum chamber, the vacuum chamber receiving the fluid pressure from the primary vacuum passage.

48. The vacuum table of claim 47 wherein the vacuum chamber comprises a primary vacuum chamber located below the primary zone and adapted for transferring the fluid pressure to the primary zone, and a plurality of selectively sealable vacuum passages located below the variable zone and adapted for selectively transferring the fluid pressure to the variable zone, the primary vacuum passage in communication with the primary vacuum chamber, and each of the selectively sealable vacuum passages having an open end in communication with the primary vacuum passage.

49. The vacuum table of claim 48 wherein mechanical regulator within the primary vacuum passage includes a first movable obstruction for selectively sealing one or more of the open ends of the selectively sealable vacuum passages wherein an area of the vacuum zone is varied in a longitudinal direction by selectively closing the selectively sealable vacuum passages with the first movable obstruction.

50. The vacuum table of claim 49 wherein mechanical regulator within the primary vacuum passage includes a second movable obstruction for selectively sealing one or more of the open ends of the selectively sealable vacuum passages wherein the area of the vacuum zone is further varied in the longitudinal direction by selectively closing the selectively sealable vacuum passages with the second movable obstruction.

51. The vacuum table of claim 50 wherein each of the selectively sealable vacuum passages includes a removable closure for selectively varying an effective length of each of the selectively sealable vacuum passages wherein the area of the vacuum zone is further varied in a second direction which is at an angle to the longitudinal direction.

52. The vacuum table of claim 51 wherein each of the removable closures are interconnected to an activation handle located along a portion of the peripheral edge of the vacuum table.

* * * * *